United States Patent [19]

Sledge

[11] Patent Number: 4,984,714

[45] Date of Patent: Jan. 15, 1991

[54] SPOUTED BOTTLE

[75] Inventor: Larry C. Sledge, Midlothian, Va.

[73] Assignee: Specialty Packaging Licensing Company, Wilmington, Del.

[21] Appl. No.: 462,213

[22] Filed: Jan. 9, 1990

[51] Int. Cl.[5] ..... B67D 1/16

[52] U.S. Cl. ..... 222/109; 222/153; 215/228; 215/330

[58] Field of Search ..... 222/108–109, 222/111, 153, 182, 424, 481, 482, 544–545, 548, 551, 562, 566, 570; 220/855 P; 215/228, 329–330, 331

[56] References Cited

U.S. PATENT DOCUMENTS

| | | | |
|---|---|---|---|
| 2,601,040 | 6/1952 | Livingstone | 222/568 |
| 4,289,248 | 9/1981 | Lynn | 215/330 |
| 4,387,822 | 6/1983 | Lynn | 215/330 |
| 4,454,965 | 6/1984 | Kirk, Jr. | 222/153 |
| 4,699,285 | 10/1987 | Perne et al. | 215/252 |
| 4,706,829 | 11/1987 | Li | 215/354 |
| 4,773,560 | 9/1988 | Kittscher | 222/109 |
| 4,802,597 | 2/1989 | Dubach | 215/307 |
| 4,830,234 | 5/1989 | Odet | 222/465.1 |

FOREIGN PATENT DOCUMENTS

| | | | |
|---|---|---|---|
| 106092 | 4/1965 | Norway | 215/330 |

*Primary Examiner*—Michael S. Huppert
*Attorney, Agent, or Firm*—Dallett Hoopes

[57] ABSTRACT

In this assembly the spout attachment has at the top of its vertical wall a flat annular wiper flange having an upstanding sealing bead. The flange is clamped between the top of the mouth of the bottle and the undersurface of the closure so that the bead seals against the closure and no liner is necessary in the closure. To keep the attachment from uncontrolled rotation as the closure is screwed on and off, the vertical wall of the attachment is provided with a pair of horizontally aligned closely spaced lugs which straddle an inward protrusion in the mouth of the bottle.

10 Claims, 1 Drawing Sheet

SPOUTED BOTTLE

BACKGROUND OF THE INVENTION

1. Field of the Invention

This invention relates to spouted plastic bottles. More specifically, this invention relates to spout attachments which include sealing means so that it is not necessary to provide a liner in the bottle closure. It also relates to means to maintain the attachment against rotation in the mouth of the bottle.

2. Description of Related Art including Information Disclosed under §§1.97 to 1.99

The prior art includes a number of molded spout attachments for plastic molded bottles. As an example, the U.S. Pat. No. 4,706,829, which issued Nov. 17, 1987 to Li discloses an attachment which has an inverted U-shaped margin which snaps over the top of the mouth of the bottle. The closure for this bottle has a seal or a liner that is engaged by a bead at the top of the U-shaped margin.

Other spout attachments are disclosed in U.S. Pat. No. 2,763,403 which issued Sept. 18, 1956 to Livingstone. Some of the disclosures in Livingstone include spout attachments in which a flange rides on the top of the mouth of the bottle between the mouth and the closure. The disclosure suggests that it is possible to eliminate the use of a liner in the closure, but presumably the result is often that as the closure is tightened, the spout turns relative to the mouth, disorienting the spout. This is a critical shortcoming when the bottle is formed with a integral handle and direction of spout pour should be opposite the handle.

Other patents which disclose spout attachments are: U.S. Pat. Nos. 4,078,700; 4,128,189; 4,550,862; 4,671,421; 4,696,416;

SUMMARY OF THE INVENTION

This invention is a spouted bottle including a spout attachment for a plastic molded bottle, the attachment including a flanged margin having an upward bead thereon adapted to form a seal with the closure when the closure is screwed down tight. The flange may serve as a wiper seal against the closure. The invention further involves the provision of anti-rotation means which, in the preferred embodiment, comprises a pair of spaced triangular outward lugs on the vertical wall of the spout attachment. These lugs are disposed in a groove or recess inside the mouth of the bottle and on either side respectively of an inward protrusion in the groove or recess and control rotation of the spout with respect to the mouth of the bottle. The anti-rotation means assures that the focus of the spout will remain in a relatively constant direction: important in a handled or especially shaped bottle.

BRIEF DESCRIPTION OF THE DRAWINGS

Other features and objects of the invention will be apparent to those skilled in the art from a review of the following specification and reference to the drawings, all of which disclose a non-limiting embodiment of the invention. In the drawings.

DESCRIPTION OF THE PREFERRED EMBODIMENT

Figure 1:
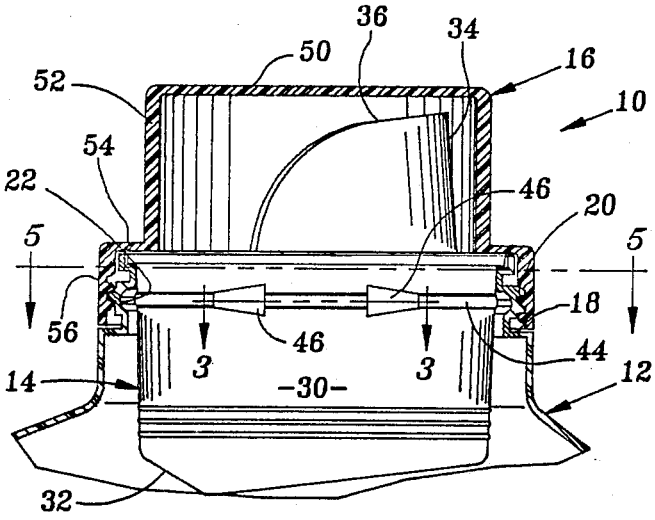
FIG. 1 is a fragmentary sectional view taken vertically through the bottle mouth and closure and showing the attachment in profile.
Figure 3:
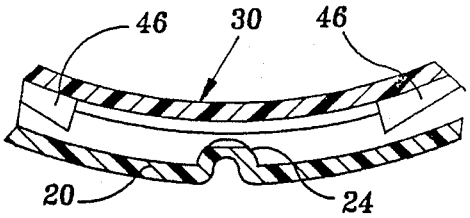
FIG. 3 is a greatly enlarged sectional view taken on the line 3—3 of FIG. 1 (showing only in section the mouth of the bottle and the spout attachment)
Figure 5:
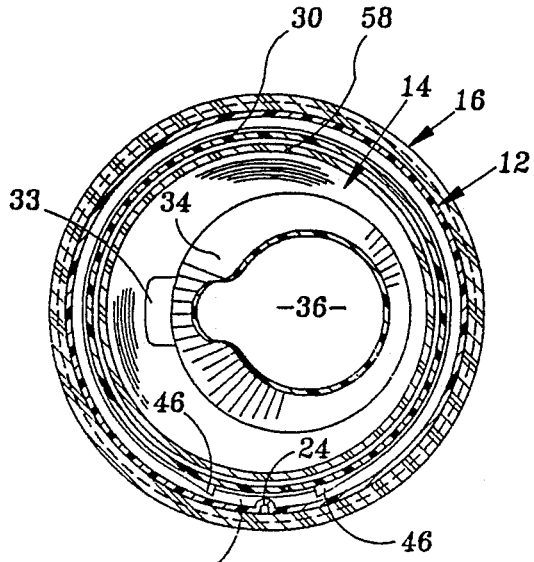
FIG. 5 is a sectional view taken on the line 5—5 of FIG. 1.

An embodiment of the invention, including the spout attachment, is generally designated 10 in FIG. 1. It comprises a molded bottle 12 which may have a built-in handle (not shown), the spout attachment 14 having a directional spout opening (FIG. 5), and a closure 16.

The bottle, as shown, has converging side walls which extend upward and inward to present an upwardly facing annular shoulder 18. Above the shoulder is a threaded mouth 20 as is conventional. Interiorly the mouth is formed with a outward annular groove or recess 22. In the recess there is formed an inward protrusion 24 which may be an intentionally molded hump shape reamed off at its peak to assure clearance. Alternatively, the protrusion 24 may be a "dam" commonly produced in the extrusion blow molding of handled bottles that are "flashed". Such "dams" occur in handleware bottles as plastic is pushed to the inside of the neck of the bottle at the parting line as the mold is closed.

Figure 2:
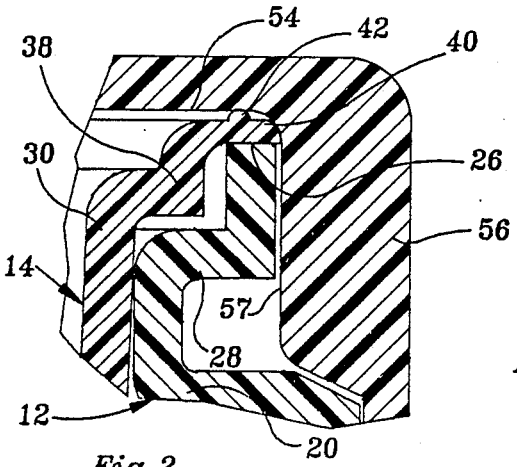
FIG. 2 is a greatly enlarged sectional view taken at the juncture of the spout attachment, bottle mouth and closure.
Figure 4:
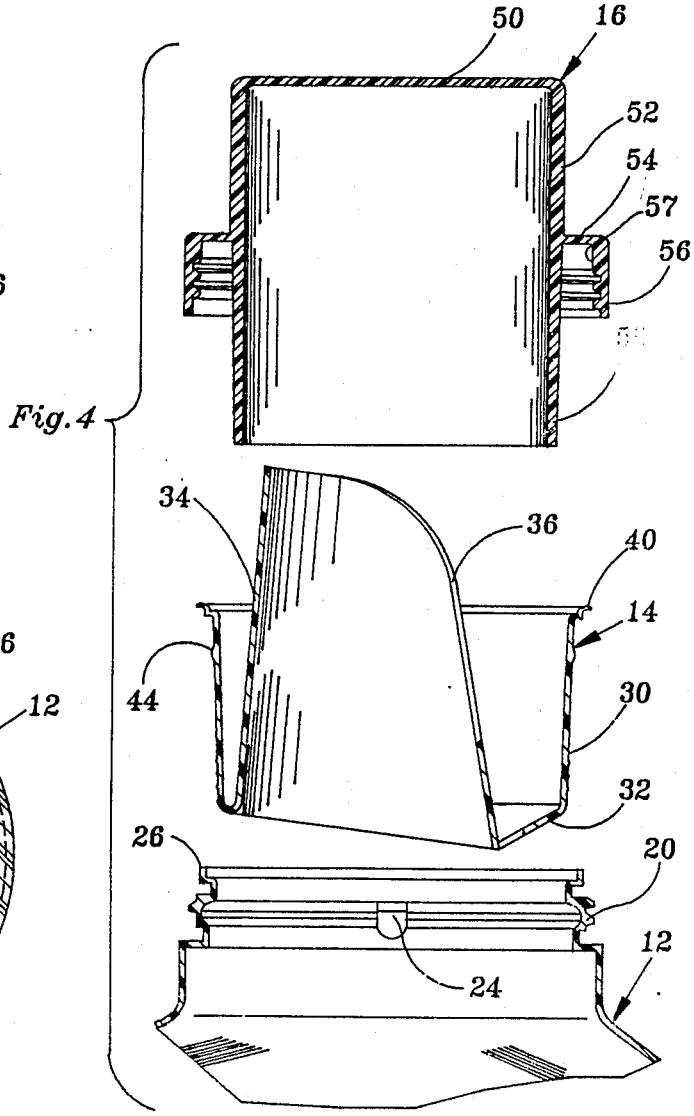
FIG. 4 is an exploded view showing the bottle, attachment, and closure prior to assembly. The spout is turned 180° from its position in FIG. 1.

The top end of the mouth of the bottle is formed with a lip 26 (FIG. 2). Just below the lip 26 the mouth is formed with an outward offset shelf 28.

The attachment 14 (FIG. 1) includes a vertical outer wall 30 at the bottom of which is an annular bottom wall 32 from the inner edge of which the spout wall 34 extends upward and provides an opening 36. The annular bottom wall 32 is provided with a drain-back opening 33 (FIG. 5), which is conventional.

The upper end of the vertical wall 30 is formed with an outward annular offset 38 (FIG. 2) from the top of which an outward wiper flange 40 extends. The top of the wiper flange is formed with an upward annular bead 42. The outer margin of the flange is tapered and engages the inside of the closure (FIG. 2).

Beneath the offset 38 the vertical wall 30 is formed with an annular outward ridge 44 (FIG. 1). To the side of the spout the ridge is enlarged to present outward triangularly-shaped lugs 46 which are disposed on either side of the protrusion 24. As shown, vertical sides of the triangles face each other. The upper and lower surfaces of the lugs 46 may be blended into the wall 30, the blending on the underside of the lugs serving to make easier the downward installation of the attachment into the bottle as the wall moves past the mouth of the bottle. The blending on the upper side of the lugs 46 makes the spout attachment 14 easier to strip up out of its mold when it is being produced.

Completing the assembly is the closure 16 which comprises a flat top wall 50, a depending side wall 52 and offset shoulder 54. The undersurface of offset 54 provides a flat surface against which the bead 42 seals and a depending annularly threaded skirt 56. The threads on the inside of the skirt stop short of the undersurface of offset 54 to present a short cylindrical inside wall 57 as shown (FIG. 2, 4). The side wall 52 extends down into a depending sleeve 58, so that when inverted, the shape 50, 52, 58 provides a measuring cup.

In assembly the spout attachment 14 is inserted in snug fit into the mouth 20 of the bottle 12 until the ridge 44 snaps into the groove 22 about the inside of the mouth 20 and is oriented so that the lugs 46 are disposed on either side of the protrusion 24. With the attachment 14 in installed position, the offset 38 of the attachment is at or above the offset 28 of the mouth of the bottle (FIG. 2) and the flange 40 rests on the lip 26 to establish the level of the lugs 46 at the same height as the protrusion 24.

The closure 16 is then brought down so that its depending sleeve 58 is disposed between the spout wall 34 and the vertical wall 30 of the attachment 14. The closure is next threaded onto TM the mouth 20 as shown and, in doing so, the outer edge of the flange 40 wipes (FIG. 2) against the short cylindrical inside wall 57 above the threads on skirt 56. As the closure is screwed all the way "home", the undersurface of the offset 54 engages the bead 42 and presses the flange down against the lip 26 of the bottle thereby compressing the bead 42 against the offset 54 to seal the closure. The alignment of the bead 42 and lip 26 therefore is important to effect a good seal.

Every time the closure is taken off or replaced on the bottle, there is a tendency to cause the rotation of the attachment within the mouth 20. However, the anti-rotation means; that is, the lugs 46 which are on either side of the protrusion 24, limits the rotation of the attachment in either direction as the closure is screwed on and off. Just how much rotation the anti-rotation means does permit will depend upon the spacing: the width of the protrusion 24 and the distance between the lugs 46.

It will thus be seen that the spout of the invention does not require a liner on the undersurface of offset 54. At the same time, because of the anti-rotation means 46, 24 the spout retains the proper orientation in direct line (if it is so arranged) with the handle of the bottle at all times.

As a reasonable variation, it is envisioned that the anti-rotation means herein could have its parts reversed and still retain many of the features of the invention. In such a reversal, the protrusion 24 can be formed outward on the wall 30 and the two rotation-limiting lugs 46 can be inward in the groove or recess 22 in the mouth of the bottle on either side of the protrusion 24.

It should thus be clear that while the invention is disclosed in one form, variation of the shapes and arrangement of the parts are possible within the scope of the invention which may be defined by the following claim language or equivalents thereof.

What is claimed is:

1. In a molded spout component for a spouted molded bottle, the bottle having a normally upward circular mouth with threads formed on the outside thereof and a groove about the inside surface of the mouth with an inward protrusion in the groove, the spout being one piece and comprising a downward generally cylindrical outer wall, an inwardly directed annular bottom wall and a doubled-back upward cone-like spout wall having an opening at its upper end, the annular bottom wall being formed with a combined vent-and-drain-back passage outward and upward seal means about the per end of the outer wall adapted to rest on the top of the mouth of the bottle, the improvement of a pair of closely spaced outward lugs molded into the outer wall of the spout adjacent the upper end thereof, the spout adapted to fit snugly inside the mouth with the lugs snapped into the groove on opposite sides of the protrusion to thereby limit rotation of the spout with respect to the mouth of the bottle.

2. The molded spout as claimed in claim 1 wherein the lugs are generally triangular in shape, with one side of each triangle being vertical and facing the protrusion.

3. The molded spout as claimed in claim 1 wherein the lugs are blended into the cylindrical wall.

4. A spouted bottle assembly comprising:

(a) a molded plastic bottle having a mouth with exterior threads, an outward annular groove about the inside of the mouth, the groove having an inward protrusion therein and an upward terminal lip at the top of the mouth, (b) a molded directional spout snugly disposed in the mouth and having vertical outer wall with an outward flange about the top thereof and an upward annular bead on the flange and on the vertical wall a pair of horizontally aligned closely spaced outward in the lugs disposed on either side of the inward protrusion in the mouth, and (c) a molded closure comprising a top wall and vertical sidewalls having an outward offset with a downward annular threaded skirt, the closure adapted to be screwed down tight on the mouth to seal the bead against the underside of the offset whereby the lugs in cooperation with the protrusion keep the spout from excessive turning relative to the mouth so that the orientation of the spout relative to the bottle is maintained.

5. A spouted bottle assembly as claimed in claim 4 wherein the threads on the skirt of the closure stop short of the top thereof to form a short cylindrical inside wall above the threads and the end of the flange forms a wiper seal for said short cylindrical inside wall of the closure.

6. A spouted bottle assembly as claimed in claim 4 wherein an annular outward ridge is formed in the vertical wall at the level of the lugs.

7. A spouted bottle assembly as claimed in claim 4 wherein the lugs are generally triangular in shape with one side of each triangle being vertical and facing the protrusion.

8. A spouted bottle assembly as claimed in claim 4 wherein the lugs are smoothly blended into the cylindrical wall.

9. A spouted bottle assembly as claimed in claim 4 wherein the bead is vertically aligned with the mouth therebelow and the offset thereabove whereby when the closure is screwed "home" the pressure on the bead against the offset is concentrated because of the alignment of the mouth directly under the bead.

10. In a spouted molded bottle comprising:

a. a bottle having a normally upward circular mouth element with threads formed on the outside thereof, and b. a one-piece spout disposed snugly in the mouth element and defined by a downward, generally cylindrical outer wall element, an inwardly directed annular bottom wall and a double-back upward cone-like spout wall having an opening at its upper end, the annular bottom wall being formed with a combined vent-and-drain-back passage, outward and upward seal means about the upper end of the outer wall element resting on the top of the mouth element of the bottle, the improvement of a pair of closely spaced lugs molded into one of the mouth and outer wall elements and extending toward the other of the elements and a protrusion on the said other of the elements facing toward the said one of the elements, the lugs disposed on opposite sides of the protrusion, one of the elements having a groove at the level of the protrusion and lugs to receive said protrusion or lugs, the groove serving to keep the spout in the mouth element and the lugs and protrusion serving to limit rotation of the spout with respect to the mouth element of the bottle.

* * * * *